US009131782B1

(12) United States Patent
Baker

(10) Patent No.: US 9,131,782 B1
(45) Date of Patent: Sep. 15, 2015

(54) MODULAR POD MATTRESS

(71) Applicant: Roger Baker, Tulsa, OK (US)

(72) Inventor: Roger Baker, Tulsa, OK (US)

( * ) Notice: Subject to any disclaimer, the term of this patent is extended or adjusted under 35 U.S.C. 154(b) by 0 days.

(21) Appl. No.: 14/266,931

(22) Filed: May 1, 2014

(51) Int. Cl.
*A47C 27/00* (2006.01)
*A47C 27/06* (2006.01)

(52) U.S. Cl.
CPC ..... *A47C 27/001* (2013.01); *A47C 27/064* (2013.01); *A47C 27/062* (2013.01)

(58) Field of Classification Search
CPC ... A47C 27/001; A47C 27/062; A47C 27/064
USPC ..... 5/691, 716, 720, 722, 723, 727
See application file for complete search history.

(56) References Cited

U.S. PATENT DOCUMENTS

| | | | | |
|---|---|---|---|---|
| 1,276,361 | A * | 8/1918 | Hobert | 5/722 |
| 1,528,066 | A * | 3/1925 | McEntire | 5/722 |
| 3,031,690 | A | 5/1962 | Ramsay | |
| 4,955,095 | A | 9/1990 | Gerrick | |
| 5,393,938 | A | 2/1995 | Bumbalough | |
| 5,471,688 | A * | 12/1995 | Cavazos | 5/251 |
| 5,960,496 | A | 10/1999 | Boyd | |
| 6,055,689 | A | 5/2000 | Cavazos | |
| 6,122,787 | A * | 9/2000 | Kao | 5/723 |
| 6,523,198 | B1 * | 2/2003 | Temple | 5/604 |
| 7,454,810 | B2 | 11/2008 | Wells | |
| 7,493,668 | B2 | 2/2009 | Piraino | |
| 7,757,322 | B2 | 7/2010 | An | |
| 7,861,342 | B1 * | 1/2011 | Huang | 5/716 |
| 8,117,700 | B2 * | 2/2012 | Howard | 5/690 |
| 8,181,296 | B2 | 5/2012 | Rawls-Meehan | |
| 8,256,712 | B2 | 9/2012 | Sorensen | |
| 8,370,979 | B2 | 2/2013 | Fukano | |
| 2004/0255387 | A1 * | 12/2004 | England | 5/728 |
| 2008/0098533 | A1 * | 5/2008 | Erdman | 5/722 |
| 2009/0038080 | A1 * | 2/2009 | Grigg | 5/720 |
| 2009/0126107 | A1 * | 5/2009 | Kuo | 5/400 |
| 2013/0239323 | A1 | 9/2013 | Schulz, Jr. et al. | |

OTHER PUBLICATIONS

Dual Custom Comfort Control beds | Natural Form® http://www.naturalform.com/n/4/dual-custom-comfort-controls, Feb. 19, 2014.

* cited by examiner

*Primary Examiner* — Michael Trettel
(74) *Attorney, Agent, or Firm* — Head, Johnson & Kachigian, P.C.

(57) ABSTRACT

A modular pod mattress with an integral mattress subsurface platform rail system, a plurality of modular pods to be securely fitted into the mattress subsurface platform rail system, a first compartment to house a mattress lining, and a second compartment to house a mattress topper. The mattress subsurface platform rail system comprises a plurality of rails for forming a series of track mounting spaces for receiving and securing the plurality of modular pods. Each modular pod consists of a plurality of coils springs with varying elasticity that is dependent on the user's height and weight distribution. The modular pods may be removed and replaced pod by pod once worn as opposed to replacing the entire mattress.

22 Claims, 4 Drawing Sheets

MODULAR POD MATTRESS

CROSS REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A SEQUENCE LISTING, A TABLE, OR A COMPUTER PROGRAM LISTING APPENDIX

Not Applicable.

BACKGROUND OF THE INVENTION

1. Field of the Invention

This invention relates generally to a mattress used for sleeping. More particularly, this invention relates to a mattress comprising a subsurface platform rail system holding pods in stable position, a plurality of removable and replaceable modular pods each filled with a plurality of pocket coils which are dependent on the height and the weight distribution over the user's body.

2. Description of the Related Art

A conventional sleeping mattress is typically limited in levels of comfort, and similarly limited to options customizable to the user's individual health, support and comfort needs. A conventional mattress is generally a uniform composition across the entire mattress. For instance, the mattress may have all firm pocket coils, or all soft pocket coils across the entire mattress. Although conventional mattresses may be chosen from limited options based upon consumer preference, i.e. firm, medium, or soft, they are usually not correctly fitted for differing distribution of the type of coils across the mattress corresponding with the type of coil needed for a particular portion of the user's body. For example, a person with back pain may need firmer or softer pocket coils in the area of the mattress supporting the back, as compared to the pocket coils supporting the leg portion of the body.

Further, when two people share a bed, it is difficult to customize a conventional mattress for both of the users' comfort needs. For instance, when a larger person shares a bed with a smaller person, a mattress is usually not fitted for both users' needs.

Further yet, over time conventional mattresses become worn, soiled and tend to sag. Once a mattress becomes worn, even if only in one portion, then the entire mattress is in need of being replaced and discarded. Conventional mattresses are large and heavy and therefore moving and replacing the mattress can be burdensome and difficult, as well as expensive. Further, disposing of the entire mattress can be wasteful and environmentally unsound.

Although prior patents have disclosed mattresses attempting to solve the above described problems they still fall short. For example, U.S. Pat. No. 7,493,668 B2, U.S. Pat. No. 6,055,689 and U.S. Pat. No. 7,757,322 each disclose a mattress with divisional support; however they are limited to more generalized adjustable regions offering a limited amount of adjustability and particularity of support for each region of the body. With large general regions the mattresses of the prior art cannot be customized or particular enough to provide adequate support in precise regions.

It is therefore desirable to provide a modular pod mattress that allows for support and elasticity that corresponds to the user's height and weight distribution and provides adequate support in particular and precise regions.

It is also desirable to provide a modular pod mattress that allows for adjustable corresponding support and elasticity to the user's height and weight distribution when user's height and weight change over time.

It is also desirable to provide a modular pod mattress that allows for use by two different users of varying weight and height.

It is further desirable to provide a modular pod mattress that allows for easy and eco-friendly replacement.

It is yet further desirable to provide a modular pod mattress that allows for replacing only the portions of the mattress that needs to be replaced.

It is further desirable to provide a modular mattress that is easy to move and transfer from site to site by allowing for removal of associated parts separately, reducing the overall total weight of the mattress.

BRIEF SUMMARY OF THE INVENTION

In general, the invention relates to a mattress used for sleeping. More particularly, this invention relates to a mattress including comprising a subsurface platform rail system holding pods in stable position, a plurality of removable and replaceable modular pods each filled with a plurality of pocket coils which are dependent on the height and the weight distribution of a user's body.

A modular pod mattress, comprising a mattress subsurface platform rail system, a plurality of modular pods to be securely fitted into the mattress subsurface platform rail system, a first compartment adjacent to the mattress subsurface platform rail system to house a mattress lining, and a second compartment adjacent to the first compartment to house a mattress topper, wherein the mattress subsurface platform rail system comprises a plurality of rails for forming a series of track mounting spaces for receiving and securing the plurality of modular pods.

The series of rails comprises a plurality of bottom rails forming a perimeter, a plurality of corner rails that connect to the plurality of bottom rails, a pair of opposing longitudinal top side rails that connect to the plurality of corner rails, a pair of opposing rails extending along an upper end and a lower end of the mattress and are also connected to the plurality of corner rails, a plurality of guide rails extending from one side of the bottom rails to an opposed side of the bottom rails, and a dividing rail extending longitudinally from the upper end rail to the lower end rail.

The plurality of bottom rails, the plurality of corner rails, and the pair of opposing longitudinal top side rails are all "L" shaped rails forming a right-angled flange to secure and support the modular pods as described herein. The upper end and lower end opposing top rails are flat or planar shaped rails with no flange. The guide rails and the dividing rail are "T" shaped rails forming two right-angled flanges to secure and support the modular pods as described herein. The series of rails is composed of a lightweight and durable composite material such as but not limited to fiber carbon composite, vacuumed formed polycarbonate, or aluminum.

The modular pods each comprise a plurality of coil springs, such as but not limited to pocket springs. The modular pods with coil springs are enveloped by a heavy cloth material, such as but not limited to muslin material. The coil springs in each modular pod may be of varying elasticity such as soft, medium, firm or a combination. The level of elasticity in each modular pod is dependent on the user's height and weight distribution. The modular pods with varying elasticity are then arranged in a series of track mounting spaces created by the mattress subsurface platform rail system. The arrangement of the modular pods corresponds to the where the user needs more or less elasticity depending on how much support the region of their body needs.

When the coil springs in the modular pods wear out and need to be replaced, the modular pods may be removed from the mattress subsurface platform rail system by the user. A zipper enclosure un-zips allowing access to the modular pods. The modular pods are then lifted up out of the subsurface platform rail system and taken to a store to be replaced. The mattress has a first compartment adjacent to the mattress subsurface platform rail system and modular pods. This first compartment houses a mattress lining that may be made of Kevlar sheeting. The Kevlar sheeting is surrounded by general purpose padding. The first compartment may be attached by zipper attachment and may be completely removed from the mattress. A second compartment is adjacent to the first compartment and houses a mattress topper by zipper enclosure. The mattress topper is chosen by the user based upon user preferences. The mattress topper may be composed of, but is not limited to, feathers, horse hair, cotton, wool or memory foam. The first and second compartments may also be divided into two half sections to allow for two users sharing the same bed to have individual, optimal comfort preferences.

The varying embodiments of the modular pod mattress are constructed so that an optimal and customizable comfort level is achieved for different people with varying weights and heights. Upon purchase, each user is weighed and measured on certain scales that provide exact weight and height distribution. These measurements are used to construct a mattress that corresponds to the user's support needs which may vary from one area of the body to the next.

DETAILED DESCRIPTION OF THE INVENTION

The devices discussed herein are merely illustrative of specific manners in which to make and use this invention and are not to be interpreted as limiting in scope.

While the devices have been described with a certain degree of particularity, it is to be noted that many variations and modifications may be made in the details of the sequence and the arrangement of the devices without departing from the scope of this disclosure. It is understood that the devices are not limited to the embodiments set forth herein for purposes of exemplification.

Figure 1:
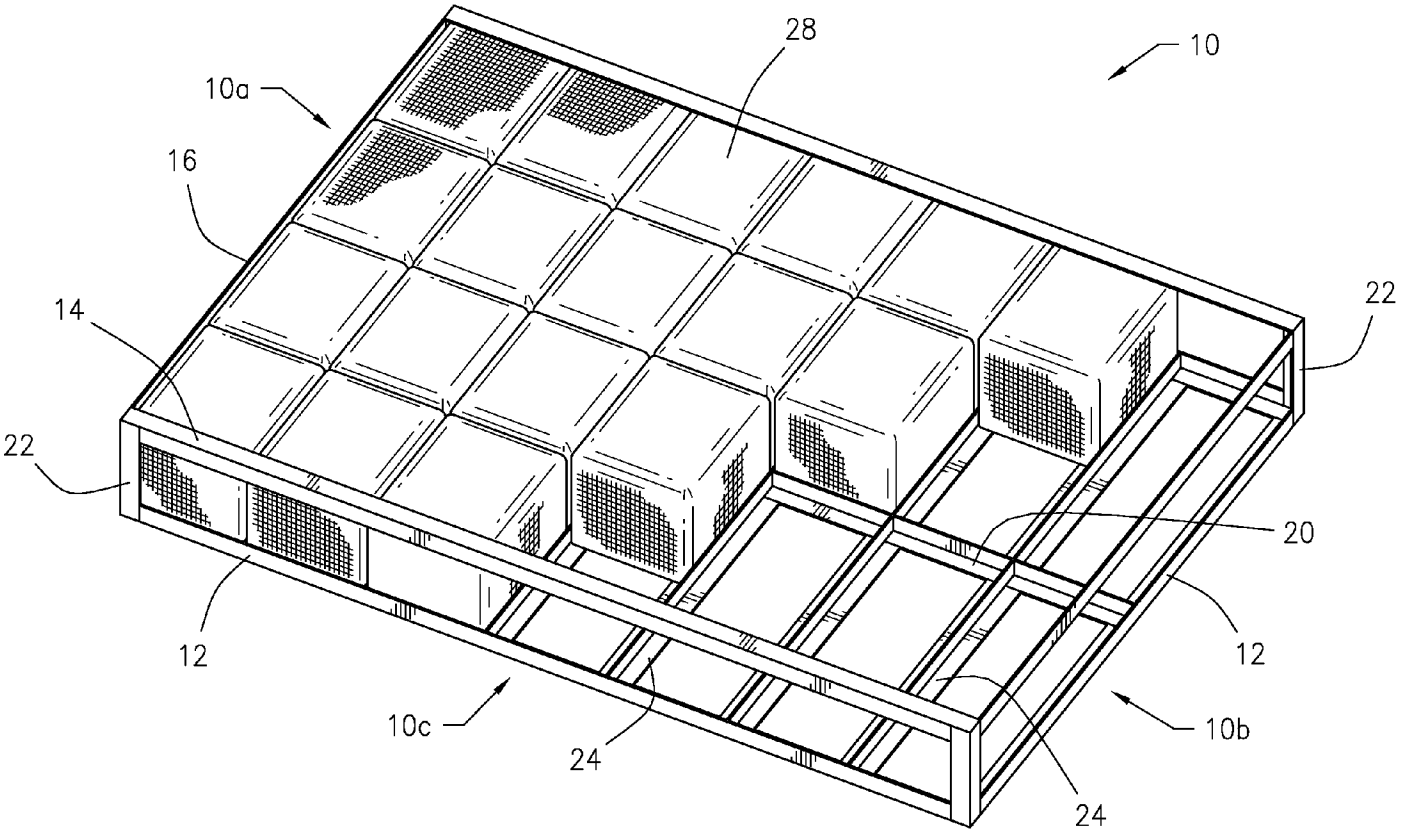
FIG. 1 illustrates a perspective view of a modular pod mattress in accordance with the present invention.

FIG. 1 illustrates a modular pod mattress 10 with upper end 10*a* and lower end 10*b*. Mattress 10 includes a subsurface platform rail system comprising bottom rails 12 going around the entire perimeter of the mattress. Corner rails 22 extend perpendicularly and upwardly from each corner of the perimeter. The corner rails 22 are connected to the bottom perimeter rails 12 by connective means. The corner rails 22 connect to top rails 14 which extend along opposing sides of the mattress. For instance, a top rail 14 is shown extending along the mattress side 10*c*. Two opposing rails 16 are connectively engaged to corner rails 22 and opposing top rails 14. Opposing rails 16 are extend along upper end 10*a* of the mattress and lower end 10*b* of the mattress. Bottom rails 12, corner rails 22, and top side rails 14 may be "L" shaped rails each comprising a right angle, or lip. Opposing rails 16 may be flat or planar rails without a lip. Bottom rails 12, corner rails 22, top side rails 14 and opposing rails 16 are preferably made of a durable and lightweight composite material, although the rails should not be so limited and could be made of various other types of durable, lightweight material.

Bottom rails 12 create a subsurface platform rail system or perimeter for a plurality of guide rails 24. The plurality of guide rails 24 extend parallel from one another and connect two opposing bottom rails 12, as best shown in FIG. 1. One dividing rail 20 extends longitudinally connecting two opposing bottom rails from upper end 10*a* to lower end 10*b*. In essence, the dividing rail 20 segregates alignment and arrangement of the modular pods 28 in a dual person mattress. The plurality of guide rails 24 and dividing rail 20 may be "T" shaped rails which create two opposing right angles. Guide rails 24 and dividing rail 20 are preferably made of a durable and lightweight composite material, although the rails should not be so limited and could be made of various other types of durable, lightweight material.

The aforementioned rails collectively create a subsurface platform rail system to guide, support and stabilize a plurality of modular pods 28. The bottom rails 12 are "L" shaped to allow for the modular pods 28 to sit or rest upon. The guide rails 24 connect to two opposing bottom rails 12 and create intermediary support for the pods to rest on. The top side rails 14 are "L" shaped to create an upper flange or lip. Modular pods 28 along longitudinal side 10*c* are therefore snuggly secured between the lip or flange of bottom rail 12 and the lip of flange of top side rail 14. Modular pods in this position (alongside opposing longitudinal sides) cannot be lifted directly in the upwards position. Therefore, the modular pods 28 need to be slid along guiderails 24 toward the center of the mattress and then lifted upward to be removed. During use, the subsurface platform rail system prevents the pods from shifting due to user movement and general ware.

Figure 3:
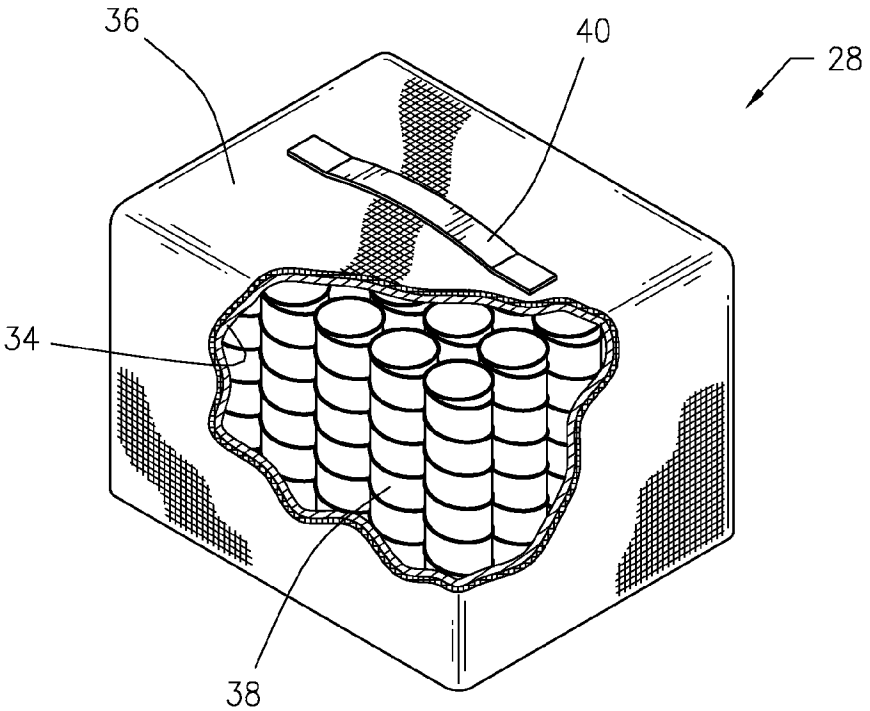
FIG. 3 illustrates a perspective and cut-away view of a mattress pod in accordance with the present invention.

A singular modular pod is illustrated in FIG. 3. Each modular pod 28 consists of a plurality of metal coil springs 38 having a variety of firmness and support. Each modular pod 28 may have a plurality of coils 38 with a variety of elasticity, and can be arranged and situated so that the pods may be of five different elasticity levels including soft; medium soft; medium; medium firm; and firm. The coils 38 may be Marshall, or pocket, coils but the coils should not be so limited and could be many other types of coils such as bonnell coils, offset coils, continuous coils, or other types of helical spring coils widely known in the art. Further, the coils 38 may not be coils and could also consist of foam padding.

The plurality of coils 38 are contained, covered, and enclosed by a heavy cloth material such as muslin. This covering creates a coil bag 36 with handle 40 so that each modular pod may be easily transported. The plurality of coils 38 rest upon a thin, sturdy platform which is also contained within the coil bag 36. The modular pod platform may be made of a polycarbonate material. Each modular pod 28 is intended to be removable, customizable, and replaceable by the user. After determination of the user's height and weight distribution by way of divisional scales, each modular pod 28 may be oriented and arranged in the subsurface platform rail system to correspond with weight distribution and particularized level of support needed for a corresponding region of the user's body. Over time, a user may gain or lose weight or need more support in a certain region, as such, the modular pods may be removed and the plurality of coils 38 may be replaced with a different type of coils or different elasticity of coils depending on what the user's needs. The plurality of modular pods 28 allow for distinctive and precise levels of support and comfort for a corresponding region of a user's body, however the pods 28 are assembled into the subsurface platform rail system in order to provide a single integrated mattress.

Each modular pod 28 is of similar size, preferably one foot (1 ft.) in length and one and a half feet (1.5 ft.) in width and easily fit into and associates with the rails of the mattress subsurface platform rail system described herein. Each pod is of similar size for ease of replacing and manufacturing the pods. In order to have a standard sized California King, it is preferable to have four (4) modular pods along side 10*a* and seven (7) modular pods along side 10*c*. An embodiment having such parameters is illustrated in FIG. 1. However, it should be appreciated that the dimensions of the modular pods and the number of modular pods in the preferred embodiments may be manipulated and varied to allow for different sizes of standard mattresses, such as double, queen, or king.

Figure 4:
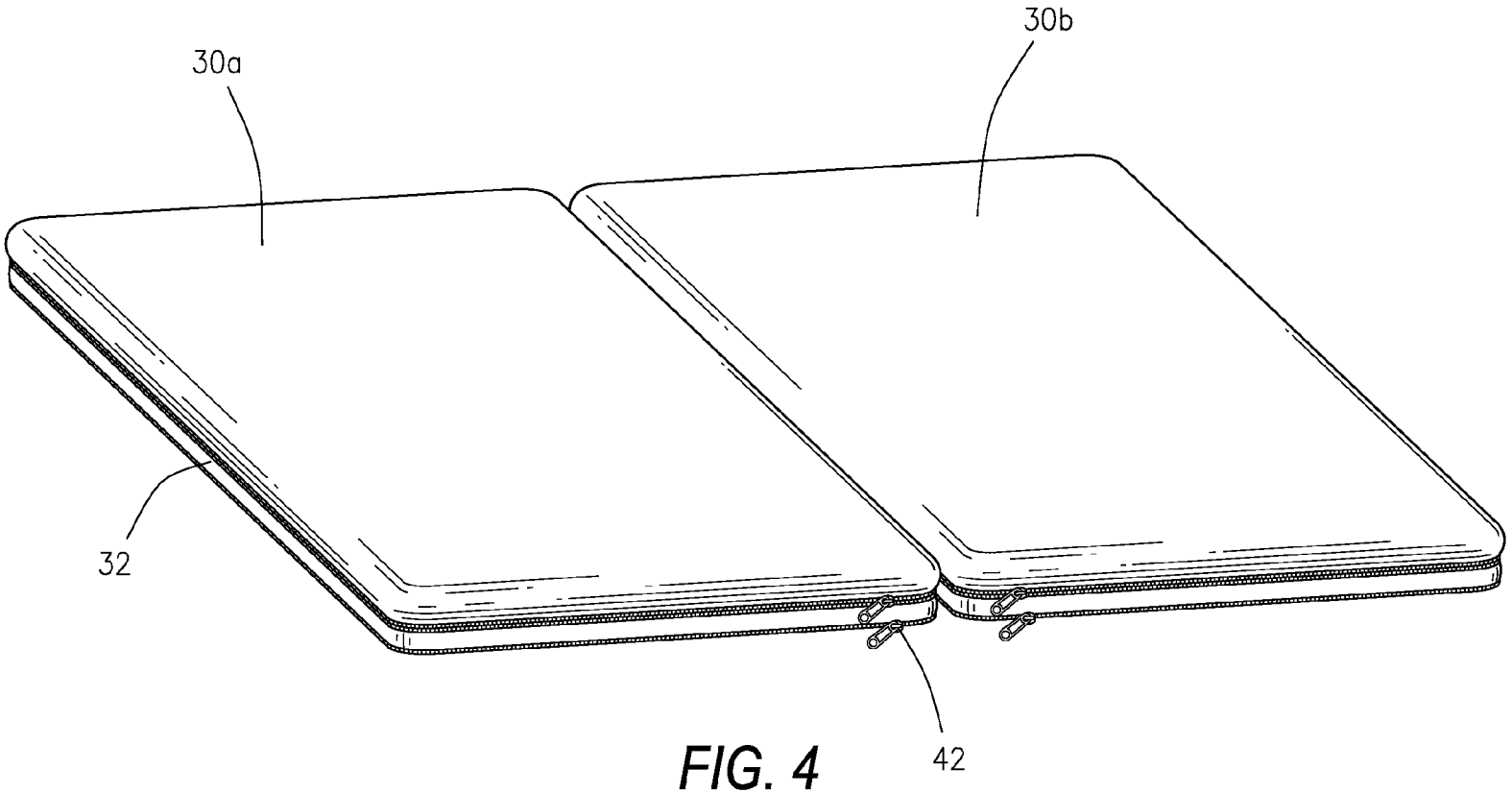
FIG. 4 illustrates a perspective view of a top portion of a modular pod mattress in accordance with the present invention.

FIG. 4 illustrates a detachable mattress topper 30. The mattress topper 30 may be divided into two halves or sections, 30*a* and 30*b*, to optimize each users' needs. The mattress topper 30 is enclosed within a second compartment that attaches by zipper attachment to a first compartment. Mattress topper 30 may be any mattress topper commercially available such as but not limited to feathers, foam, memory form or other various topper material. The mattress topper 30 has an insert which is enclosed in a fabric compartment with zipper enclosures 42. The zipper enclosure 42 may guide around the three outer edges of both topper 30*a* and topper 30*b*, therefore, there is no zipper guide along the center line between topper 30*a* and topper 30*b*. The mattress topper insert can therefore be removed and replaced by opening the zipper enclosure 42 and removing the mattress topper insert. A mattress lining 32 may be contained within another zipper enclosed compartment, a first compartment, which is directly underneath and adjacent to the mattress topper 30. The mattress assembly may be entirely covered by a material such as muslin. The first compartment may be attached to the mattress assembly by zipper attachment and may be completely removable from the mattress. The mattress lining may be made of durable material such as commercially available Kevlar sheeting, or other durable protective materials. The mattress lining 32 may be removed and replaced by means similar to replacing the mattress topper 30 insert. The mattress lining 32 may be further surrounded by padding. Conventional mattresses are known to collect bodily fluids and residues from the user's skin and body. The completely detachable and removable mattress topper provides for replacement of soiled portion of the mattress without replacing the entire mattress.

Figure 2:
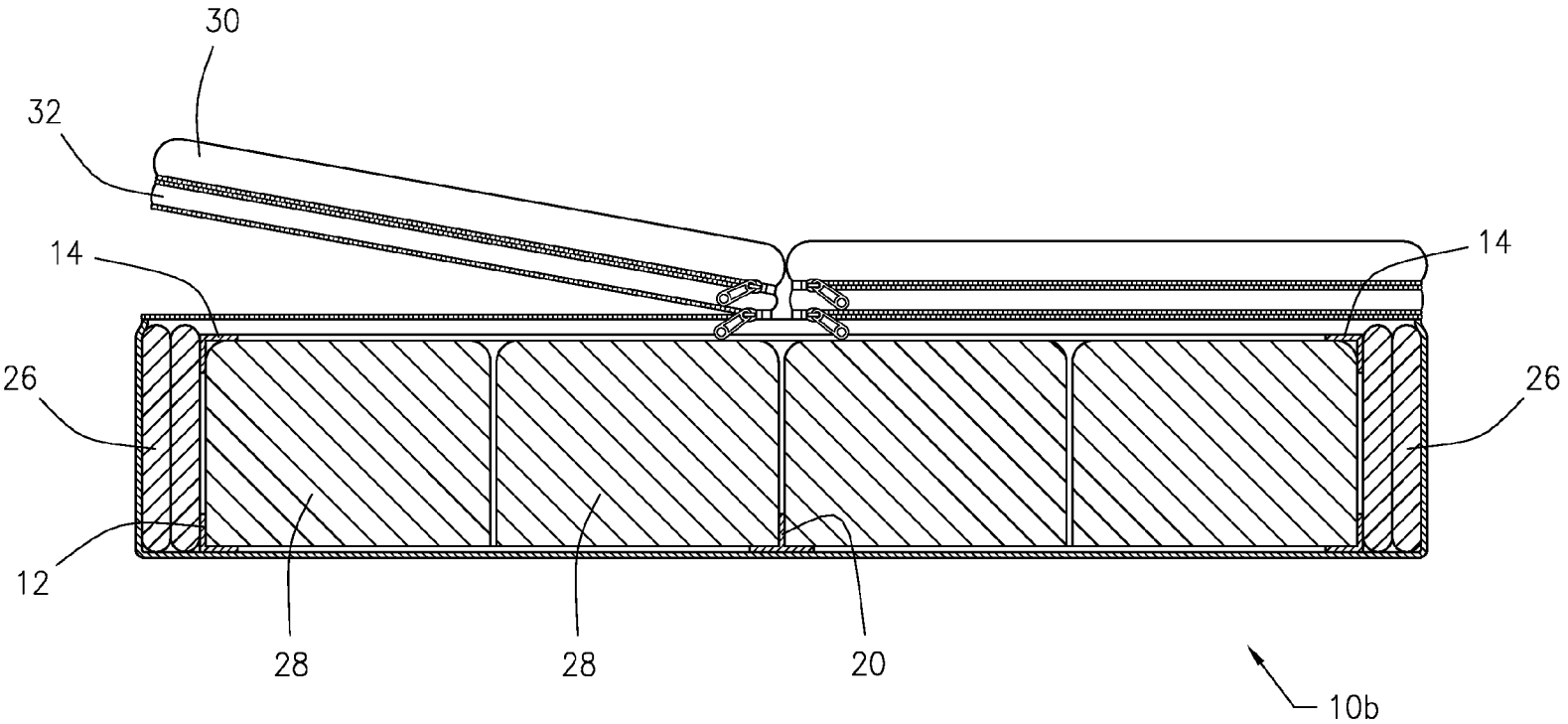
FIG. 2 illustrates a sectional view of a modular pod mattress in accordance with the present invention.

FIG. 2 illustrates a sectional view of the mattress 10 according to the present disclosure. FIG. 2 is shown from lower end 10*b*. Modular pods 28 rest upon and are secured in place by bottom rails 12 and dividing rail 20. Modular pods 28 along outer edges are securely stationed between the flange of bottom rails 12 and top side rails 14. In order to remove modular pods 28 on the extreme edges, they must be moved toward the center of the mattress and pulled directly upward. With the lip of top side rails 14, modular pods 28 may not be removed directly upward. Exterior padding 26 may be used along the perimeter of the entire mattress 10. Exterior padding 26 surrounds every side and part of the mattress subsurface platform rail system railing. The mattress subsurface platform rail system is very shallow, and integral in the construction of the mattress and is not felt or seen by the user. The exterior padding 26 is preferably multiple layers of padding material, preferably including cotton weave barrier, memory foam, gel foam, and ticking but should not be so limited, as other non-limiting padding materials may be used. The exterior padding 26 surrounds all four sides of the mattress 10 to provide a cushion buffer around the perimeter of the rail system. A heavy cloth material is then used to cover and envelope around the exterior padding 26. A mattress lining 32 provides a cover above the modular pods 28 within a zipper enclosed first compartment. A commercially available mattress topper 30 is directly above the mattress lining 32. Mattress topper 30 is contained within a zipper enclosed second compartment. The zipper enclosures for both the mattress topper 30 and the mattress lining 32 guide alongside all edges of the compartments as to allow for access into the compartments and provide a completely removable first and second compartment. As illustrated in FIG. 2, the zipper enclosed first compartment un-zips in order to access the modular pods 28 for removal and replacement of the modular pods 28. Further, the zipper enclosed second compartment surrounding the mattress topper 30 may un-zip in order to remove and replace the mattress topper 30.

The varying embodiments of the modular pod mattress 10 described herein are constructed so that a customizable comfort and support level is achieved for different people with varying weights and heights. The modular pod mattress 10 as described herein may pair with any type of available foundation such as a traditional box spring or low-profile bed platform.

Whereas, the devices have been described in relation to the drawings and claims, it should be understood that other and further modifications, apart from those shown or suggested herein, may be made within the scope of this invention.

What is claimed is:

1. A modular pod mattress, comprising:

a mattress subsurface platform rail system;

a plurality of modular pods to be securely fitted into said mattress subsurface platform rail system;

a first compartment adjacent to said mattress subsurface platform rail system to house a mattress lining;

a second compartment adjacent to said first compartment to house a mattress topper;

said mattress subsurface platform rail system comprising a plurality of rigid rails for forming a series of track mounting spaces for receiving and securing said plurality of modular pods, said plurality of rigid rails further comprising:

a pair of opposing bottom rails extending longitudinally along said modular pods;

a plurality of guide rails extending latitudinally along said modular pods and connecting said pair of opposing bottom rails; and a dividing rail extending longitudinally along said modular pods to and in connection with said pair of opposing bottom rails.

2. The modular pod mattress of claim 1 wherein said plurality of modular pods each comprises a plurality of coil springs.

3. The modular pod mattress of claim 1 wherein said plurality of said mattress pods are enveloped by a heavy cloth material.

4. The modular pod mattress of claim 2 wherein said plurality of coil springs vary in elasticity.

5. The modular pod mattress of claim 2 wherein said plurality of coil springs are pocket springs.

6. The modular pod mattress of claim 1 wherein said plurality of rigid rails further comprises:

a plurality of corner rails in connection with said pair of opposing bottom rails;

a pair of opposing longitudinal top side rails in connection with said plurality of corner rails;

a pair of opposing rails extending latitudinally along said modular pods and in connection with said plurality of corner rails.

7. The modular pod mattress of claim 6 wherein said pair of opposing bottom rails, said plurality of corner rails, and/or said pair of opposing longitudinal top side rails are "L" shaped rails.

8. The modular pod mattress of claim 6 wherein said pair of opposing rails are flat or planar shaped rails.

9. The modular pod mattress of claim 1 wherein said plurality of guide rails and said dividing rail are "T" shaped rails.

10. The modular pod mattress of claim 1 wherein said plurality of rigid rails is composed of a lightweight and durable composite material.

11. The modular pod mattress of claim 1 wherein said plurality of modular pods are removable from said mattress subsurface platform rail system.

12. The modular pod mattress of claim 1 wherein said first compartment is removeably attached by a zipper attachment.

13. The modular pod mattress of claim 1 wherein said second compartment comprises a zipper enclosure.

14. The modular pod mattress of claim 1 wherein said mattress topper comprises two halves.

15. The modular pod mattress of claim 1 wherein said first compartment opens to access said modular pods.

16. A modular pod mattress, comprising:

a mattress subsurface platform rail system, said mattress subsurface platform rail system further comprising:

a plurality of longitudinal lower side rails;

a plurality of latitudinal lower guide rails connected to said bottom side rails;

at least one longitudinal lower dividing rail connected to said lower guide rails;

a plurality of longitudinal upper side rails;

a plurality of latitudinal upper guide rails connected to said upper side rails; and a plurality of vertical corner rails connected to said lower side rails, said lower guide rails, said upper side rails, and said upper guide rails; and a plurality of modular pods removably secured to said mattress subsurface platform rail system.

17. The modular pod mattress of claim 16 wherein said plurality of modular pods each comprises a plurality of coil springs.

18. The modular pod mattress of claim 17 wherein said plurality of coil springs vary in elasticity.

19. The modular pod mattress of claim 16 wherein said lower side rails, said corner rails, said upper side rails, said lower guide rails, said upper guide rails or a combination thereof are "L" shaped rails.

20. The modular pod mattress of claim 16 wherein said dividing rail is "T" shaped.

21. The modular pod mattress of claim 16 wherein said mattress subsurface platform rail system is constructed from a lightweight and durable composite material.

22. The modular pod mattress of claim 16 further comprising:

a first compartment adjacent to said mattress subsurface platform rail system and configured to a mattress lining; and a second compartment adjacent to said first compartment and configured to house a mattress topper.

* * * * *